US006789794B2

(12) United States Patent
Miyazawa

(10) Patent No.: US 6,789,794 B2
(45) Date of Patent: Sep. 14, 2004

(54) SHEET CONVEYING DEVICE AND IMAGE FORMING APPARATUS EQUIPPED WITH THE SHEET CONVEYING DEVICE

(75) Inventor: Hideaki Miyazawa, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/193,285

(22) Filed: Jul. 12, 2002

(65) Prior Publication Data

US 2003/0011126 A1 Jan. 16, 2003

(30) Foreign Application Priority Data

Jul. 13, 2001 (JP) ..... 2001-214462
Jun. 27, 2002 (JP) ..... 2002-187610

(51) Int. Cl.[7] ..... B65H 5/22
(52) U.S. Cl. ..... 271/184; 271/306
(58) Field of Search ..... 271/306, 187, 271/188, 184; 162/197, 271; 39/406

(56) References Cited

U.S. PATENT DOCUMENTS 3,957,366 A 5/1976 Taylor et al. ..... 355/3 R
4,817,933 A * 4/1989 Honjo et al. ..... 271/3.04
5,218,411 A * 6/1993 Kosugiyama et al. ..... 399/341
6,273,414 B1 8/2001 Matsuo ..... 371/9.11

FOREIGN PATENT DOCUMENTS

EP 0 311 821 4/1989
JP 10-232570 9/1998

* cited by examiner

*Primary Examiner*—Donald P. Walsh
*Assistant Examiner*—Kenneth W Bower
(74) *Attorney, Agent, or Firm*—Fitzpatrick, Cella, Harper & Scinto

(57) ABSTRACT

A sheet conveying device has a conveyance guide for guiding a sheet conveyed from a photosensitive drum and a transfer roller of a transfer portion to a pressurizing roller and a fixing roller of a fixing device, and the conveyance guide has a second guide surface and a third guide surface, the bending point of the guide surfaces being situated above the intersection of the nip plane of the photosensitive drum and the transfer roller and the nip plane of the pressurizing roller and the fixing roller and in a region on the side opposite to the direction in which the sheet is separated from the conveyance guide with respect to the nip planes.

10 Claims, 17 Drawing Sheets

ENTERING POSITIONy [mm]

| TYPE OF PAPER | THICK PAPER | THICK PAPER | THICK PAPER | THICK PAPER | |
|---|---|---|---|---|---|
| CURLING STATE | UPWARD CURLING | DOWNWARD CURLING | UPWARD GUTTER CURLING | DOWNWARD GUTTER CURLING | |
| CONVENTIONAL CONFIGURATION1 | 2.38 | -3.9 | -3.6 | -3.3 | |
| CONVENTIONAL CONFIGURATION2 | -2.8 | -3.2 | -2.6 | -3.3 | |
| CONFIGURATION OF THE PRESENT INVENTION | -2.8 | -3.4 | -2.6 | -3.3 | |
| TYPE OF PAPER | THIN PAPER | THIN PAPER | THIN PAPER | THIN PAPER | |
| CURLING STATE | UPWARD CURLING | DOWNWARD CURLING | UPWARD GUTTER CURLING | DOWNWARD GUTTER CURLING | VARIATION [mm] |
| CONVENTIONAL CONFIGURATION1 | 9.77 | -4.8 | -2.9 | -4.2 | ±15 |
| CONVENTIONAL CONFIGURATION2 | 4.65 | -3.5 | -2.5 | -2.8 | ±8.2 |
| CONFIGURATION OF THE PRESENT INVENTION | -2.2 | -3.4 | -2.8 | -3 | ±1.4 |

FIG. 12

| TYPE OF PAPER | UNIFORM SYSTE | SLACKENING SYSTEM |
|---|---|---|
| THICK PAPER | O | × |
| ORDINARY PAPER | O | × |
| THIN PAPER | Δ | × |

O:NO TRACES OF RIBSTO BE OBSERVED

Δ:TRACES OF RIBS TO BE OBSERVED AT SHEET ENDS

×:TRACES OF RIBS TO BE OBSERVED

FIG. 14A

| TYPE OF PAPER | UNIFORM SYSTEM | SLACKENING SYSTEM |
|---|---|---|
| THICK PAPER | O | O |
| ORDINARY PAPER | O | O |
| THIN PAPER | O | O |

FIG. 14B

ENTERING POSITION y[mm]

| TYPE OF PAPER | THICK PAPER | THICK PAPER | THICK PAPER | THICK PAPER | |
|---|---|---|---|---|---|
| CURLING STATE | UPWARD CURLING | DOWNWARD CURLING | UPWARD GUTTER CURLING | DOWNWARD GUTTER CURLING | |
| 10° >A≧B、Lc>(La+Lb+Lc)/3 | 0.94 | -2.3 | -1.9 | -1.7 | |
| A≧B>30°、Lc>(La+Lb+Lc)/3 | -1.6 | -2.5 | -1.8 | -2.4 | |
| 10° ≦A<B≦30°、Lc≦(La+Lb+Lc)/3 | -2.8 | -3.4 | -2.6 | -3.3 | |
| TYPE OF PAPER | THIN PAPER | THIN PAPER | THIN PAPER | THIN PAPER | |
| CURLING STATE | UPWARD CURLING | DOWNWARD CURLING | UPWARD GUTTER CURLING | DOWNWARD GUTTER CURLING | VARIATION[mm] |
| 10° >A≧B、Lc>(La+Lb+Lc)/3 | 1.58 | -2.4 | -1.8 | -2.1 | ±4.6 |
| A≧B>30°、Lc>(La+Lb+Lc)/3 | 0.17 | -2.8 | -1.3 | -2.2 | ±2.8 |
| 10° ≦A<B≦30°、Lc≦(La+Lb+Lc)/3 | -2.2 | -3.4 | -2.8 | -3 | ±1.4 |

FIG. 16

SHEET CONVEYING DEVICE AND IMAGE FORMING APPARATUS EQUIPPED WITH THE SHEET CONVEYING DEVICE

BACKGROUND OF THE INVENTION

1. Field of the Invention

The present invention relates to a sheet conveying device for conveying sheets in a vertical direction (gravitational direction) and to an image forming apparatus equipped with this sheet conveying device.

2. Description of the Related Art

As shown in FIG. 22, in a conventional sheet conveying device, there are arranged two pairs of rollers: a lower pair of rollers 1, 2 and an upper pair of rollers 3, 4, and a sheet is conveyed from the lower roller pair 1, 2 to the upper roller pair 3, 4. Between the lower roller pair 1, 2 and the upper roller pair 3, 4, there is provided a conveyance guide 54 for guiding the sheet.

In a conventional construction, this conveyance guide 54 is formed such that the bending point (the drawing shows an end of the bending line) X between the n-th surface immediately before the upper roller pair 3, 4 and the (n−1)th surface therebelow is above the intersection Y of the nip plane 110 of the lower roller pair 1, 2 (the tangent plane at the nip portion of the lower roller pair 1, 2) and the nip plane 120 the upper roller pair 3, 4 (the tangent plane at the nip portion of the upper roller pair 3, 4) (the drawing shows an end of the intersection line of the nip planes 110 and 120). In this construction, the n-th surface of the conveyance guide 54 causes the leading end of the sheet to positively abut the outer periphery of the roller 4, whereby conveyance is effected with the leading end of the sheet being directed in a stable manner.

The above-described prior-art technique, however, has the following problems.

When a sheet 70 is guided by the conventional conveyance guide 54, the sheet 70 is allowed, for example, to be raised from the conveyance guide 54, resulting in a rather unstable conveyance. Thus, the sheet 70 does not smoothly enter the nip portion of the upper roller pair 3, 4, causing jamming or the like.

Further, when this conveyance guide 54 is provided on the downstream side of a fixing roller pair of an image forming apparatus, the raised sheet abuts the fixing roller, and an unfixed toner image on the sheet is scattered by a shock of collision, resulting in a transfer deviation (hereinafter referred to as image shock).

SUMMARY OF THE INVENTION

The present invention has been made with a view toward solving the above problems in the prior art. It is an object of the present invention to provide a sheet conveying device and an image forming apparatus capable of vertically conveying sheets in a stable manner.

In accordance with the present invention, there is provided a sheet conveying device, including: upper and lower roller pairs; and a conveyance guide provided between the roller pairs and adapted to guide a sheet conveyed from the lower roller pair toward the upper roller pair, wherein the conveyance guide has first and second guide surfaces for guiding the sheet which consist of two surfaces arranged vertically so as to intersect each other, wherein the intersection of the first and second guide surfaces is situated above the intersection of the nip plane of the lower roller pair and the nip plane of the upper roller pair, and wherein the intersection of the first and second guide surfaces is situated in a region on the side opposite to the direction in which the guided sheet is separated from the conveyance guide with respect to the nip plane of the lower roller pair and the nip plane of the upper roller pair.

BRIEF DESCRIPTION OF THE DRAWINGS

FIG. 12 is a table showing experiment results regarding sheet entering position in the conveyance guide shown in FIG. 1 and a conventional conveyance guide;

FIG. 14A is a table showing experiment results regarding the relationship between the straight rib arrangement in a conveyance guide and traces of ribs, and FIG. 14B is a table showing experiment results regarding the relationship between V-shaped rib arrangement in a conveyance guide and traces of ribs;

FIG. 16 is a table showing experiment results regarding sheet entering position in various types of conveyance guide;

DETAILED DESCRIPTION OF THE PREFERRED EMBODIMENTS

First Embodiment

Figure 1:
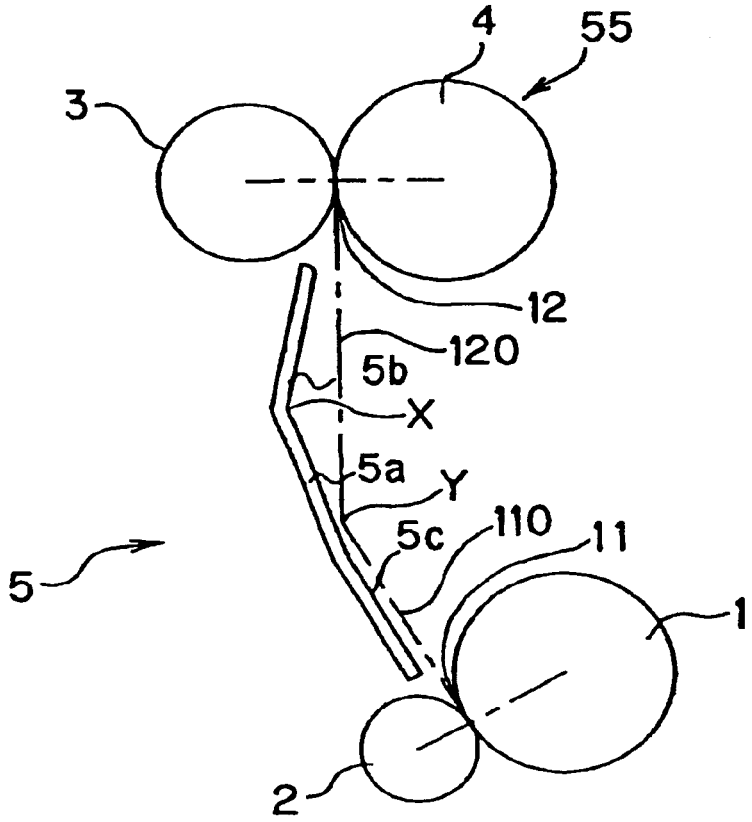
FIG. 1 is a detailed view of a conveyance guide of a first embodiment of the present invention.
Figure 2:
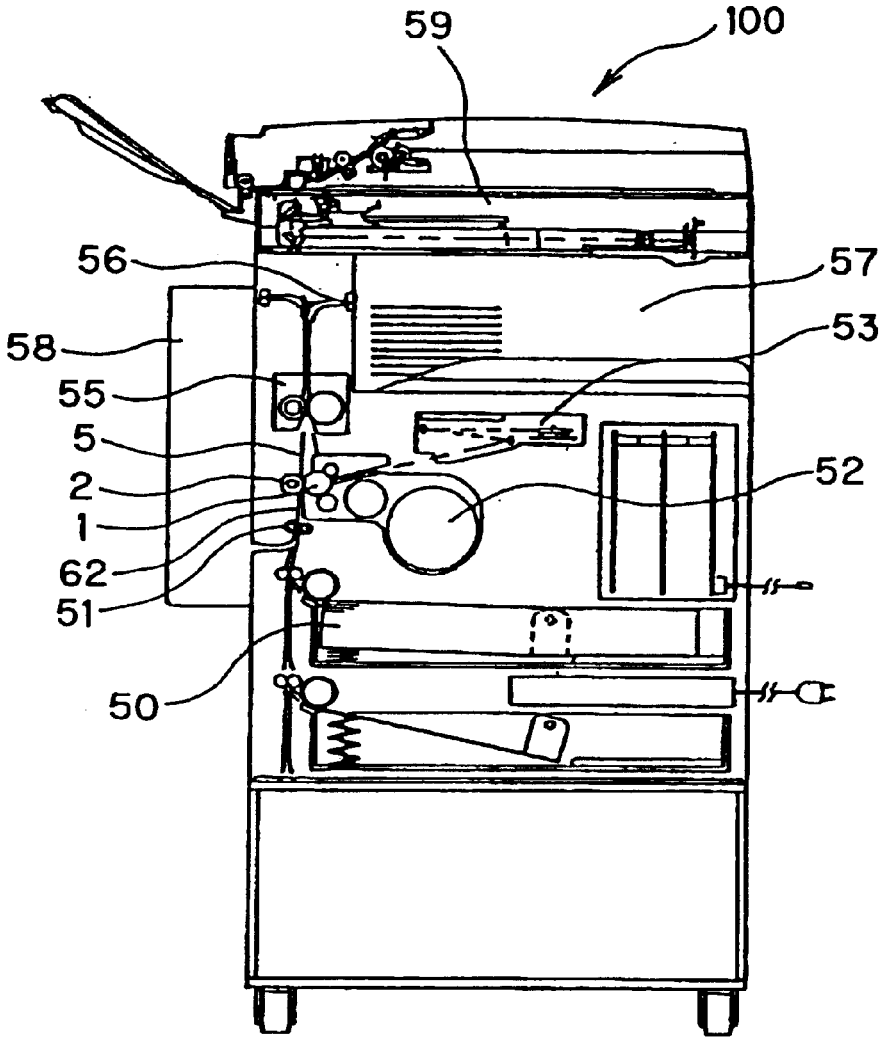
FIG. 2 is a general drawing showing an image forming apparatus having the conveyance guide shown in FIG. 1.

FIG. 1 shows the first embodiment of the present invention; it is a diagram best showing the features of a sheet conveying device for conveying a sheet in a vertical direction (gravitational direction) by upper and lower roller pairs. FIG. 2 is a general sectional view showing the construction of an image forming apparatus equipped with the sheet conveying device of FIG. 1.

First, the construction of the image forming apparatus 100 equipped with the sheet conveying device of the present invention will be described with reference to FIG. 2. Numeral 1 indicates a photosensitive drum as an image bearing body, numeral 53 indicates a laser scanner for performing scanning on the uniformly charged photosensitive drum 1 with a laser beam; numeral 52 indicates a developing device for performing development on the surface of the photosensitive drum 1 scanned with the laser beam, numeral 2 indicates a transfer roller for transferring to a sheet conveyed thereto a toner image developed on the surface of the photosensitive drum 1, and numeral 55 indicates a fixing device having a pressurizing roller 3 and a fixing roller 4 for fixing the toner image transferred by the transfer roller 2 to the sheet. These components constitute the image forming portion of the present invention.

Numeral 50 indicates a sheet feeding cassette for storing in advance sheets on which image formation is to be performed in an image forming portion, numeral 51 indicates a registration roller pair for conveying a sheet in synchronism with image transfer thereto, numeral 62 indicates a transfer guide for guiding the sheet conveyed by the registration roller pair 51 to the image forming portion, numeral 56 indicates a sheet discharging outlet for discharging the sheet that has undergone image formation in the image forming portion, numeral 57 indicates an in-apparatus sheet discharge tray for accommodating the discharged sheet, and numeral 58 indicates a two-side image-forming unit for conveying the sheet again to the image forming portion in order to form images on both sides of the sheet. Numeral 59 indicates a reader scanner unit for reading an original; image information on the original read is sent to the image forming apparatus 100, and an image is formed on a sheet in the image forming portion.

In the image forming apparatus 100 constructed as described above, the surface of the photosensitive drum 1, which is uniformly charged, is scanned with a laser beam from the laser scanner 53 corresponding to image information to thereby form a latent image on the surface of the photosensitive drum 1. By developing this latent image by the developing device 52, a toner image is formed on the surface of the photosensitive drum 1. A sheet is conveyed from the sheet feeding cassette 50, passes the registration roller pair 51, and is conveyed to the nip portion (transfer nip portion) 11 of the photosensitive drum 1 and the transfer roller 2 in synchronism with the transfer of the toner image. The sheet to which the toner image formed on the photosensitive drum 1 has been transferred passes the nip portion (fixing nip portion) 12 of the pressurizing roller 3 and the fixing roller 4 of the fixing device 55, and the toner image is fixed to the surface through pressurization and heating. Thereafter, the sheet passes the sheet discharge outlet 56 and is discharged onto the in-apparatus sheet discharge tray 57.

In FIG. 1, numeral 1 indicates the photosensitive drum, numeral 2 indicates the transfer roller in press contact with the photosensitive drum, numeral 3 indicates the pressurizing roller arranged above the photosensitive drum 1 and the transfer roller 2, and numeral 4 indicates the fixing roller in press contact with the pressurizing roller 3. FIG. 1 is a sectional view taken along a plane perpendicular to the rotation axes of the photosensitive drum 1, the transfer roller 2, the pressurizing roller 3, and the fixing roller 4.

Between the vertically arranged roller pairs, there is provided a conveyance guide 5 for guiding the sheet. This conveyance guide 5 is composed of three surfaces: a third, lowermost guide surface 5*c*, a first, middle guide surface 5*a*, and a second, uppermost guide surface 5*b*. The third guide surface 5*c* is arranged in the vicinity of the downstream side of the nip portion of the photosensitive drum 1 and the transfer roller 2 with respect to the conveying direction, and the second guide surface 5*b* is arranged in the vicinity of the upstream side of the nip portion of the pressurizing roller 3 and the fixing roller 4 with respect to the conveying direction.

In the drawing, symbol X indicates a bending point of the first guide surface 5*a* and the second guide surface 5*b* (the drawing shows an end portion of a bending line, which also applies to the following description), and symbol Y indicates the intersection of the transfer nip plane (the tangent plane at the nip portion 11 of the photosensitive drum 1 and the transfer roller 2) 110 and the fixing nip plane (the tangent plane at the nip portion 12 of the pressurizing roller 3 and the fixing roller 4) 120 (the drawing shows an end portion of the intersection line of the nip planes 110 and 120, which also applies to the following description). And, the bending point X is situated above the intersection Y of the transfer nip plane 110 of the photosensitive drum 1 and the transfer roller 2 and the fixing nip plane 120 of the pressurizing roller 3 and the fixing roller 4 of the fixing device 55. Further, the bending point X is situated in a region on the side opposite to the direction in which the sheet being conveyed is separated from the conveyance guide 5 with respect to the transfer nip plane 110 and the fixing nip plane 120.

Figure 3:
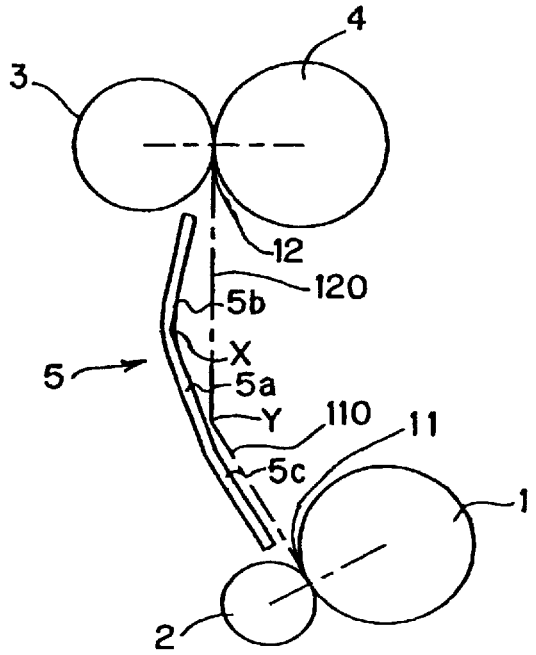
FIG. 3 is a diagram showing another example of the conveyance guide of the first embodiment of the present invention.
Figure 4:
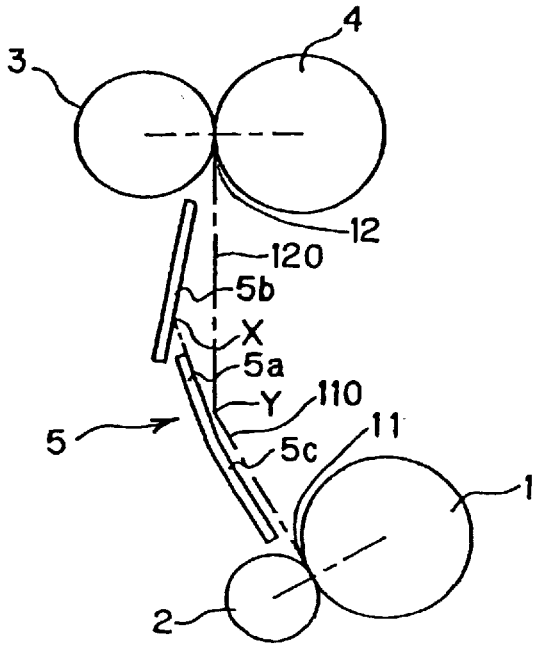
FIG. 4 is a diagram showing another example of the conveyance guide of the first embodiment of the present invention.

The construction of the conveyance guide 5 is not restricted to the one shown in FIG. 1, in which it consists of a continuous bent surface. It is also possible to adopt a construction in which, as shown in FIG. 3, the conveyance guide 5 is formed by surfaces (first and second guide surfaces 5*a* and 5*b*) connected by a curved surface (a connecting portion of the present invention) or a construction in which, as shown in FIG. 4, the conveyance guide 5 is formed by divisional surfaces (first and second guide surfaces 5*a* and 5*b*). In these cases, it is also possible to define the bending point X in the same manner as in the case of the conveyance guide 5 of FIG. 1. That is, in the cases of FIGS. 3 and 4, the bending point X is defined as the intersection of imaginary extensions of the two surfaces (first and second guide surfaces 5*a* and 5*b*) constituting the conveyance guide 5.

Thus, also in the case in which the surfaces constituting the conveyance guide 5 are connected by a curved surface (FIG. 3) and in the case in which the conveyance guide 5 is divided into a plurality of portions (FIG. 4), it is possible to form the conveyance guide 5 such that the bending point X is situated above the intersection Y of the transfer nip plane 110 of the photosensitive drum 1 and the transfer roller 2 of the transfer portion and the fixing nip plane 120 of the pressurizing roller 3 and the fixing roller 4 of the fixing device 55 and that the bending point X is situated in a region on the side opposite to the direction in which the sheet being conveyed is separated from the conveyance guide 5.

Figure 5:
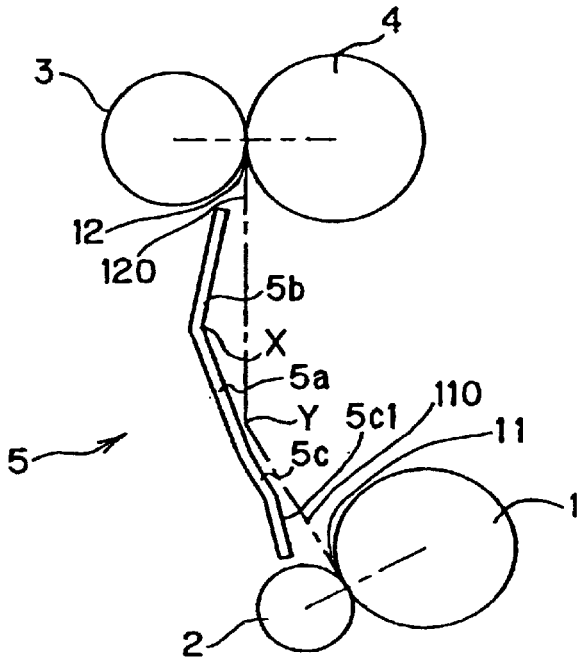
FIG. 5 is a diagram showing another example of the conveyance guide of the first embodiment of the present invention.

Further, as shown in FIG. 5, the conveyance guide 5 may have at the end portion of the third guide surface 5*c* an introducing portion 5c1 inclined such that the inclination angle on the side nearer to the transfer nip portion 11 is raised more than the angle at which the sheet is discharged from the transfer nip portion 11. Due to this introducing portion 5c1, it is possible to scoop the sheet coming out of the transfer nip 11, which further helps to prevent jamming. It is also possible to provide the configuration of the end portion 5c1 in the conveyance guide 5 of the configurations shown in FIGS. 3, 4, and 6.

Figure 6:
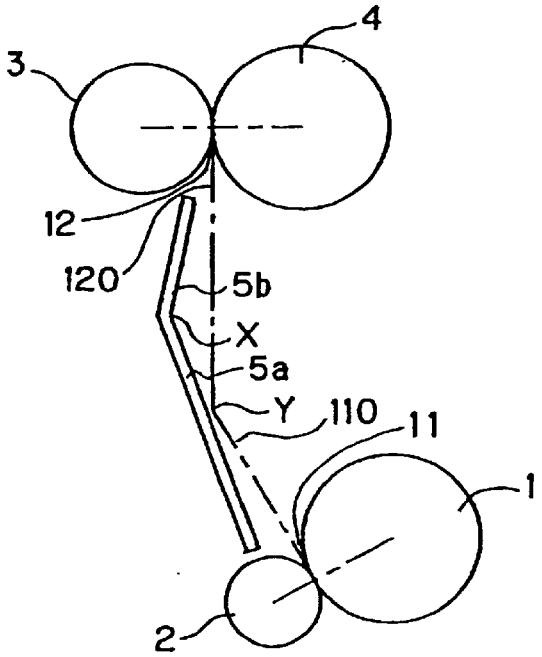
FIG. 6 is a diagram showing another example of the conveyance guide of the first embodiment of the present invention.

Further, as shown in FIG. 6, it is also possible to unite the first and third guide surfaces 5*a* and 5*c*, forming the conveyance guide 5 in two-surface structure.

Figure 7:
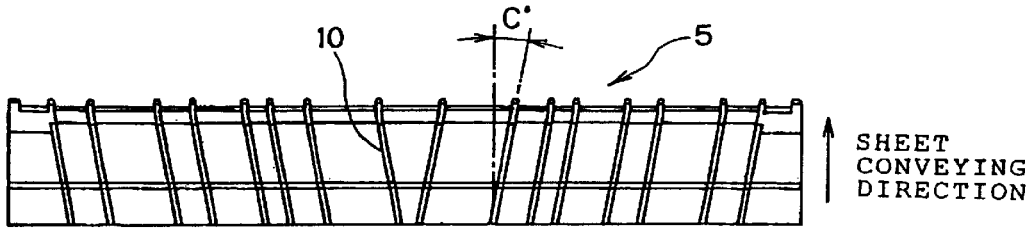
FIG. 7 is a front view of the conveyance guide shown in FIG. 1.

FIG. 7 is a front view of the conveyance guide 5 shown in FIG. 1. The conveyance guide 5 has on the sheet guiding side thereof a plurality of ribs 10 for reducing the resistance in sheet conveyance, and the sheet is conveyed with its surface with no image being supported by the ribs 10. Regarding the arrangement of the conveyance ribs 10, a V-shaped arrangement is adopted in which the ribs diverge from the transfer nip portion 11 side toward the fixing nip portion 12 side, that is, they are outwardly inclined to the right and left from the center.

Figure 8:
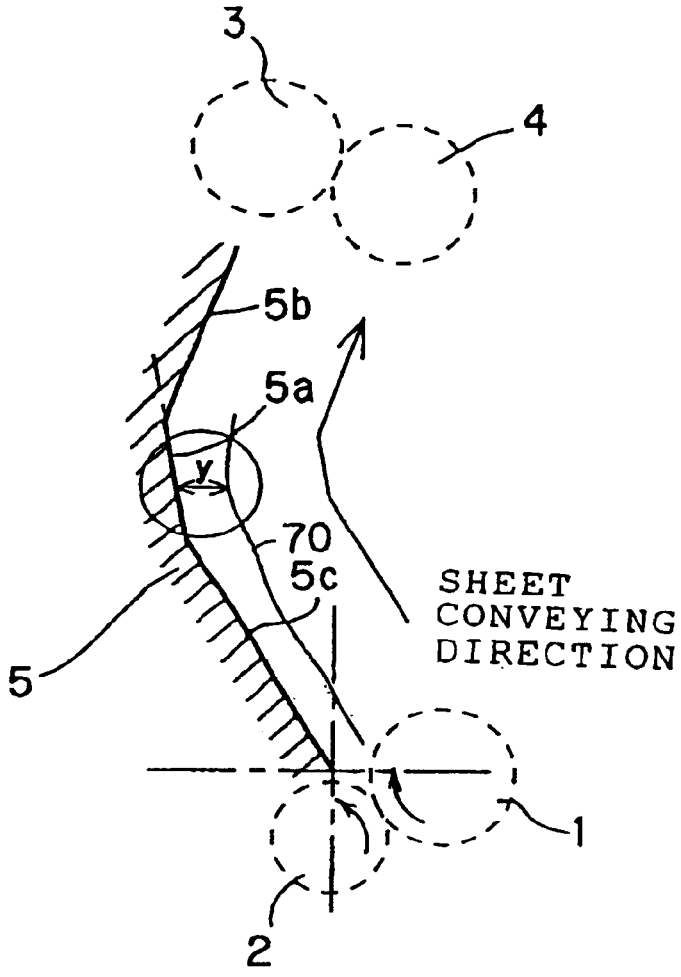
FIG. 8 is an explanatory diagram illustrating the sheet conveyance stability of a conveyance guide.

From the viewpoint of stabilizing sheet conveyance, attention was focused on the phenomenon in which the sheet from the conveyance guide 5 rises, and a comparison experiment was conducted in which sheet rising amount was measured, using various conveyance guides. FIG. 8 shows the relationship between the conveyance guide 5 and the sheet 70; symbol y indicates the amount by which the sheet rises from the conveyance guide 5.

Figure 9:
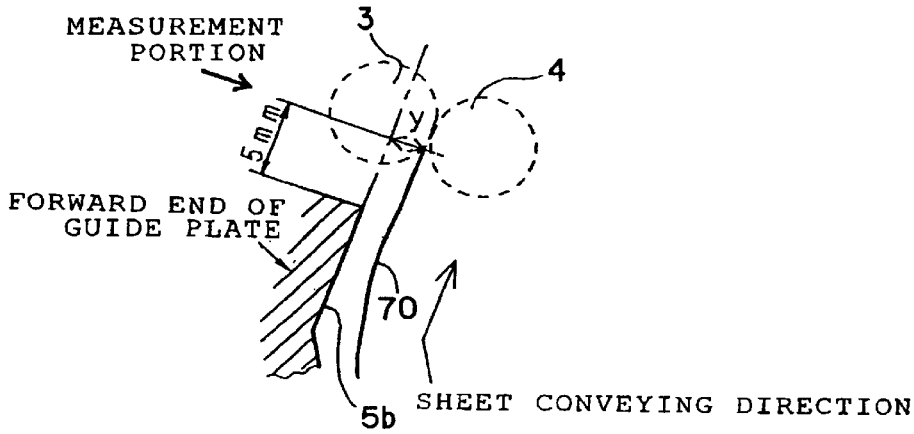
FIG. 9 is an explanatory diagram illustrating the sheet conveyance stability of a conveyance guide.
Figure 10A:
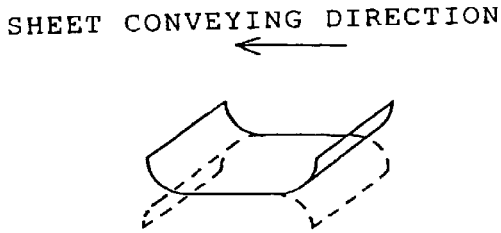
FIGS. 10A and 10B are diagrams showing shapes into which a sheet is curled.
Figure 10B:
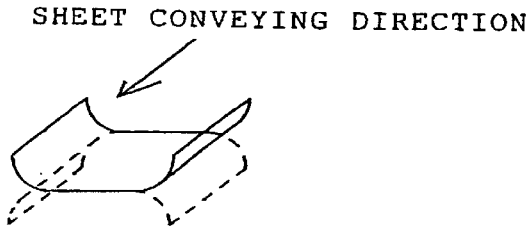

It was assumed that if the sheet is always conveyed to a fixed position at the inlet of the nip of the pressurizing roller 3 and the fixing roller 4, no jamming or image shock would occur as in the prior art, and, as shown in FIG. 9, attention was focused on the position y of the leading end of the sheet when it enters the inlet of the nip portion of the pressurizing roller 3 and the fixing roller 4 from the conveyance guide 5. The sheets used in the experiment were of two types in terms of thickness: thick paper with rigidity (128 g/m$^2$ paper) and thin paper with no rigidity (52 g/m$^2$ paper); and in terms of sheet curling, they were of four types: upward/downward curling in which the leading end and rear end with respect to the sheet conveying direction are curled upwards or downwards (FIG. 10A) and upward/downward gutter curling in which the side ends with respect to the sheet conveying direction are curled upwards or downwards (FIG. 10B). That is, the sheets used were of eight types. The position y [mm] of the sheet leading end from the conveyance guides is measured with respect to the sheet with the curling height of 20 mm at the four corners of the end portions.

Figure 11:
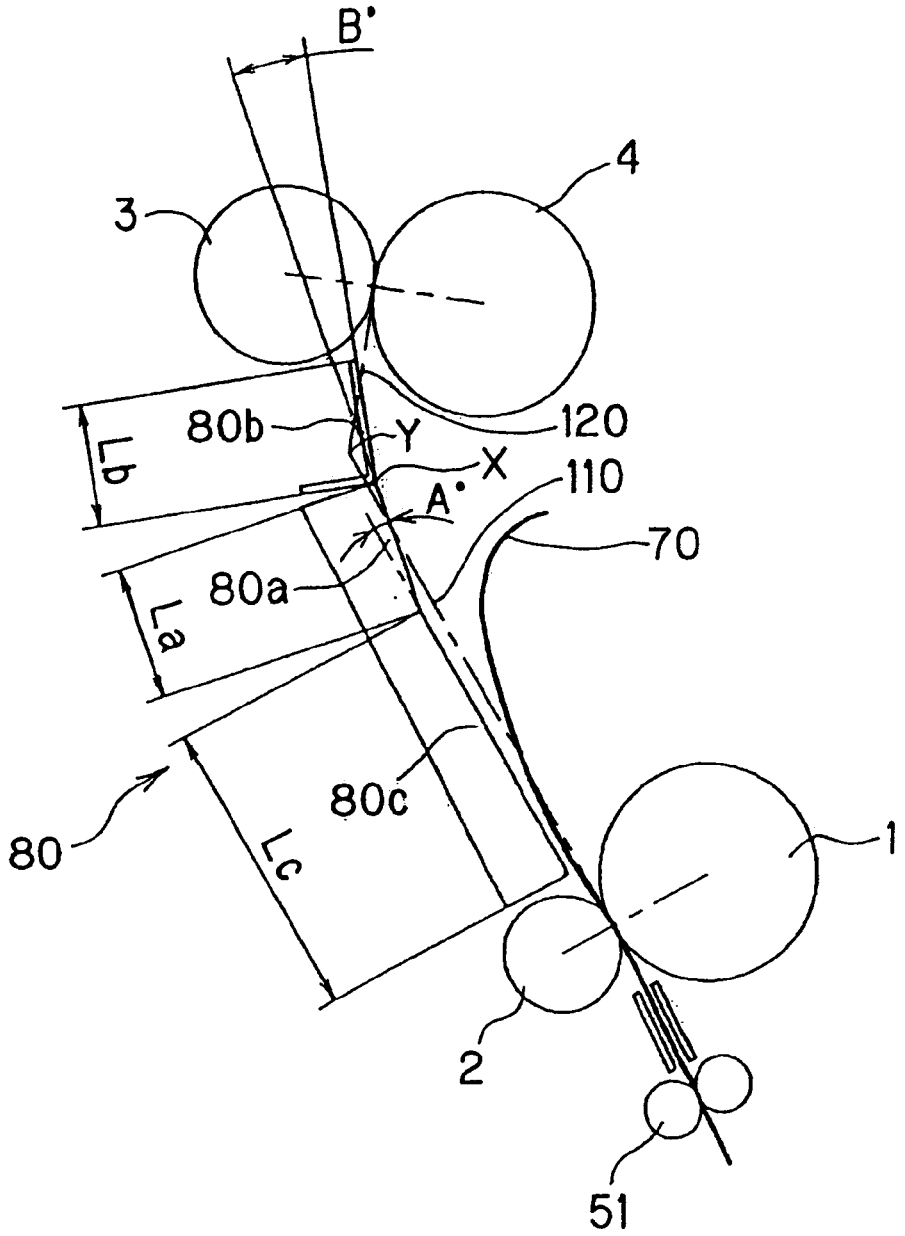
FIG. 11 PRIOR ART
FIG. 11 is a diagram showing an example of a conventional conveyance guide.
Figure 13:
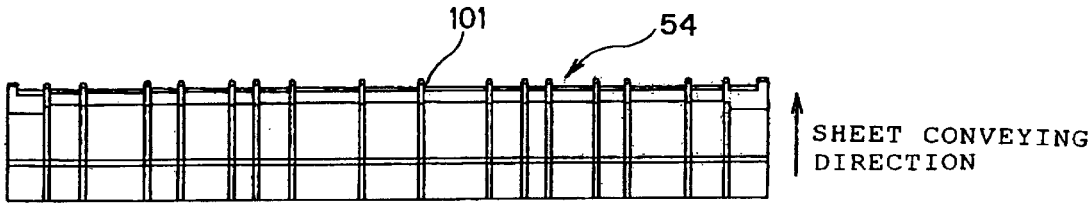
FIG. 13 is a diagram showing a straight rib arrangement in a conventional conveyance guide.

The conveyance guides used in the comparison experiment were the conveyance guide 5 of the present invention shown in FIG. 1 (configuration of the present invention), the conventional conveyance guide 54 shown in the FIG. 13 drawing (conventional configuration 1), and the conveyance guide 80 shown in FIG. 11 (conventional configuration 2).

The conveyance guide of conventional configuration 2 shown in FIG. 11 consists of three surfaces: a third guide surface 80*c*, a first guide surface 80*a*, and a second guide surface 80*b* from the lowermost to the uppermost; the third guide surface 80*c* is parallel to the transfer nip plane of the photosensitive drum 1 and the transfer roller 2; and the first guide surface 80*a* and the second guide surface 80*b* are arranged such that the bending point X thereof is not higher than the intersection Y of the transfer nip plane 110 and the fixing nip plane 120. And, the relative angle A made by the third guide surface 80*c* and the first guide surface 80*a* is approximately 10°, and the relative angle B made by the first guide surface 80*a* and the second guide surface 80*b* is approximately 10°, the angles substantially satisfying the following relationship.

$$A=B<30^\circ$$

The guide length Lc of the third guide surface is approximately 41 mm, and the total guide length La+Lb+Lc is approximately 74 mm, the guide lengths substantially satisfying the following relationship.

$$Lc>(La+Lb+Lc)/3$$

FIG. 12 shows the results of the experiment in which these three types of conveyance guides were used. FIG. 12 shows the sheet position y as measured from the guide surface and variation in the position when the paper types and the curling type were varied. As can be seen from the experiment results shown in FIG. 12, the variation is ±15 mm in the conveyance guide 54 of conventional configuration 1, and ±8.2 mm in the conveyance guide 80 of conventional configuration 2, whereas in the conveyance guide 5 of the present invention, it is ±1.4 mm, thus making it possible to convey the sheet in a stable manner to the nip portion of the pressurizing roller 3 and the fixing roller 4.

Further, the sheets were examined for traces of ribs. FIG. 13 shows the rib arrangement in the conventional conveyance guide 54, in which ribs 101 are arranged parallel to the sheet conveying direction. FIG. 7, mentioned above, shows the rib arrangement in the conveyance guide 5 of the present invention, in which rib 10 are arranged so as to diverge toward the downstream side with respect to the sheet conveying direction.

FIGS. 14A and 14B show the experiment results showing the effect of the conveyance guide 5 of the present invention in terms of traces rib as compared with the conventional conveyance guide 54. The sheets conveyed were of three kinds: thick paper, ordinary paper, and thin paper. The conveyance of the sheets was conducted in two different systems: a uniform system and a slackening system (with −1% difference in speed of two pairs of rollers). FIG. 14A shows the experiment results with the conventional conveyance guide 54 with straight rib arrangement, and FIG. 14B shows the experiment results with the conveyance guide 5 of the present invention with V-shaped rib arrangement. Symbol ○ indicates that there is no trace of rib; symbol Δ indicates that traces of ribs are to be observed at sheet ends; and symbol x indicates the presence of traces of ribs.

As shown in FIG. 14A, when a sheet with an unfixed image is guided to a conveyance guide, the conventional conveyance guide caused traces of ribs at sheet ends even in the case of the uniform system. In the case of the slackening system, the conventional conveyance guide caused traces of ribs for all kinds of paper. In contrast, in the conveyance guide of the present invention, no traces of ribs are generated under any of the conditions, thus proving very effective.

By thus applying the present invention to a sheet conveyance guide for guiding a sheet between the transfer portion and the fixing device through a longitudinal path which is vertical and short, it is possible to prevent jamming due to the failure of the sheet to smoothly enter the fixing nip portion, jamming due to curling of the sheet at the inlet portion of the sheet conveyance guide immediately after leaving the transfer portion, image shock at the time of entrance to the fixing portion, and generation of traces of ribs due to sheet slackening in a system where fixation is slow.

Figure 15:
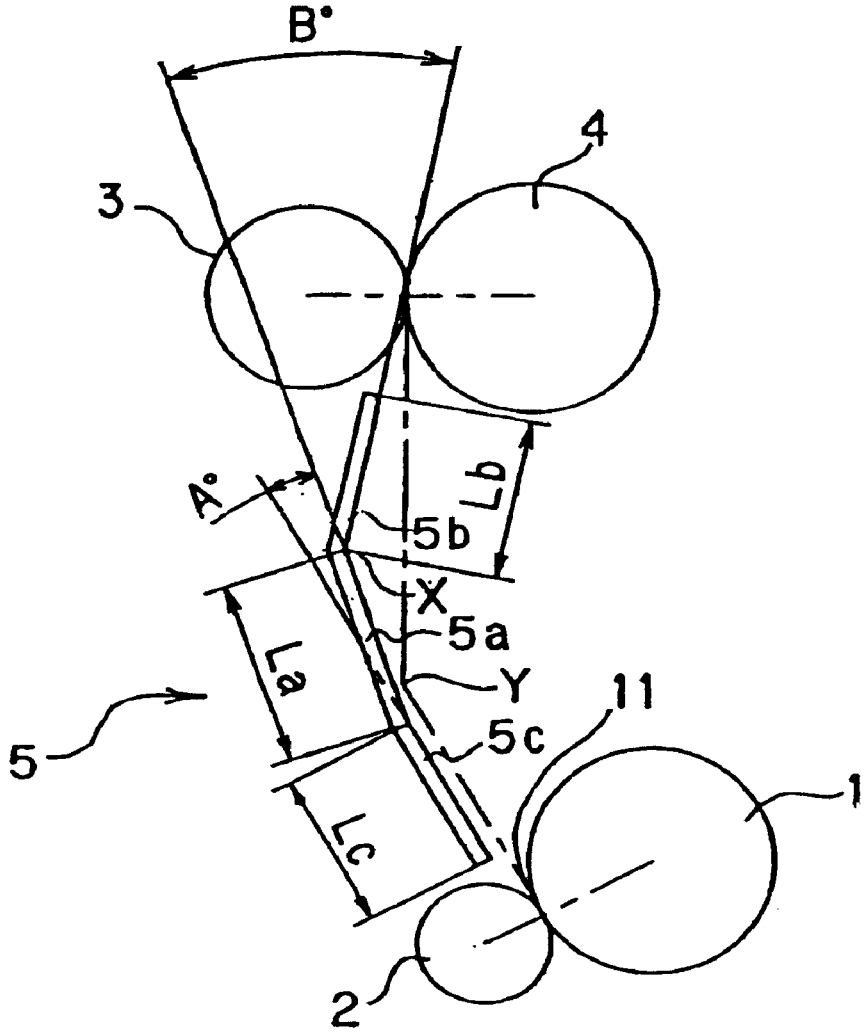
FIG. 15 is a diagram showing in detail the conveyance guide of FIG. 1.

FIG. 15 is a diagram showing in detail the construction of the conveyance guide 5 of the first embodiment of the present invention.

In the three-surface structure of the conveyance guide 5 of the present invention, the following relationship holds true:

$$10° \leqq A < B \leqq 30°$$

where A is the relative angle made by the third guide surface 5*c* arranged immediately after the transfer nip portion 11 and the next, first guide surface 5*a*, and B is the relative angle made by the first guide surface 5*a* and the second guide surface 5*b* before the inlet of the fixing portion.

Further, the following relationship holds true:

$$Lc \leqq (La+Lb+Lc)/3$$

where La is the length of the first guide surface, Lb is the length of the second guide surface, and Lc is the length of the third guide surface.

FIG. 16 shows the results of a comparison experiment conducted on a conveyance guide which is designed to satisfy the relationships: 10°>A≧B and Lc>(La+Lb+Lc)/3, a conveyance guide which is designed to satisfy the relationships: A≧B>30° and Lc>(La+Lb+Lc)/3, and a conveyance guide according to the present invention designed to satisfy the relationships: 10°≦A<B≦30° and Lc≦(La+Lb+Lc)/3. The experiment results show the sheet position y with respect to the guide surface and variation in the sheet position.

In the conveyance guide 5 of the present invention, the variation in the sheet position is ±14 mm, whereas in the conveyance guide which is designed to satisfy the relationships: 10°>A≧B and Lc>(La+Lb+Lc)/3, and the one designed to satisfy the relationships: A≧B>30° and Lc>(La+Lb+Lc)/3, the variations in sheet position are 14.6 mm and 12.8 mm, respectively. Thus, the conveyance guide 5 of the present invention proves effective in achieving stability in sheet conveyance. When the guide 6*c* near the inlet of the fixing portion is bent gently, the curling shape is not restrained, and when it is bent abruptly, the sheet will collapse (which is especially the case in upward curling). Thus, it will be seen that when the conveyance guide 5 is appropriately bent near the inlet of the fixing portion (10°≦A<B≦30°) and finally the bending is of a length allowing imparting of rigidity (Lc≦(La+Lb+Lc)/3) at the inlet of the fixing portion, the sheet can be conveyed in a stable manner.

Second Embodiment

Figure 17:
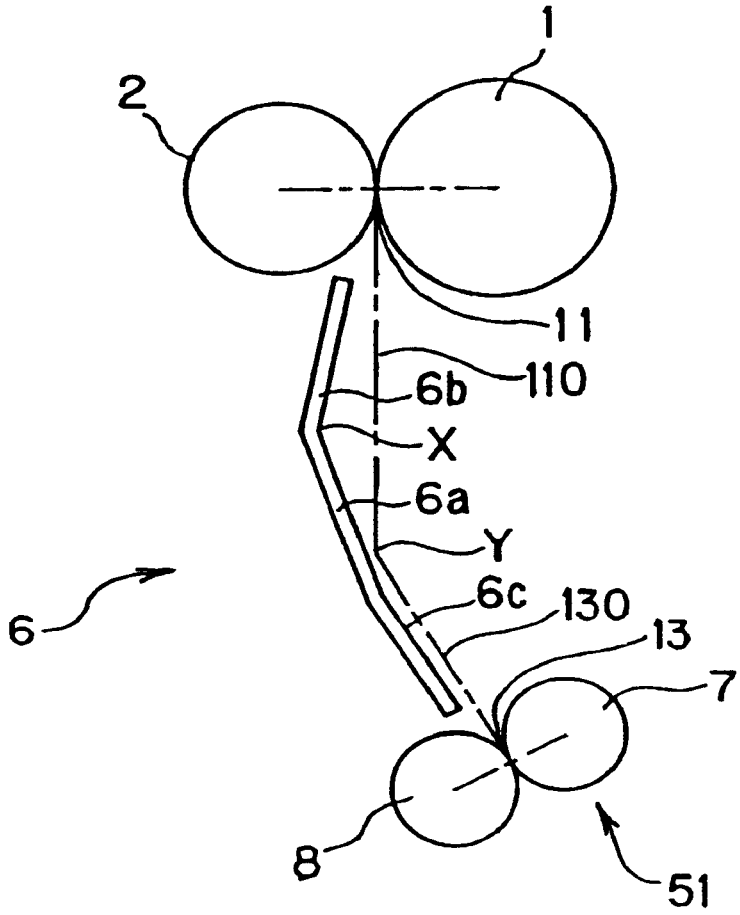
FIG. 17 is a diagram showing a conveyance guide of a second embodiment of the present invention.

Next, the second embodiment will be described. FIG. 17 shows an example in which the present invention is applied to a transfer guide 6 provided between the registration roller pair 51 and the transfer portion consisting of the photosensitive drum 1 and the transfer roller 2 in the image forming apparatus 100 shown in FIG. 2.

The registration roller pair 51 is equipped with a registration driving roller 7 and a pinch roller 8, and conveys a sheet in synchronism with image formation at the photosensitive drum 1 and the transfer roller 2.

The conveyance guide 6 for guiding the sheet between the vertically arranged roller pairs is composed of three guide surfaces: a third guide surface 6*c*, a first guide surface 6*a*, and a second guide surface 6*b* from the lowermost to the uppermost. In FIG. 17, symbol X indicates a bending point of the first guide surface 6*a* and the second guide surface 6*b*, and symbol Y indicates the intersection of the transfer nip plane (the tangent plane at the nip portion 11 of the photosensitive drum 1 and the transfer roller 2) 110 and a registration roller pair nip plane (the tangent plane at the nip portion 13 of the registration driving roller 7 and the pinch roller 8) 130. And, the bending point X is situated above the intersection Y of the nip plane 110 of the photosensitive drum 1 and the transfer roller 2 and the registration roller pair nip plane 130. Further, the bending point X is situated in a region on the side opposite to the direction in which the sheet being conveyed is separated from the conveyance guide 6 with respect to the transfer nip plane 110 and the registration roller pair nip plane 130.

Figure 18:
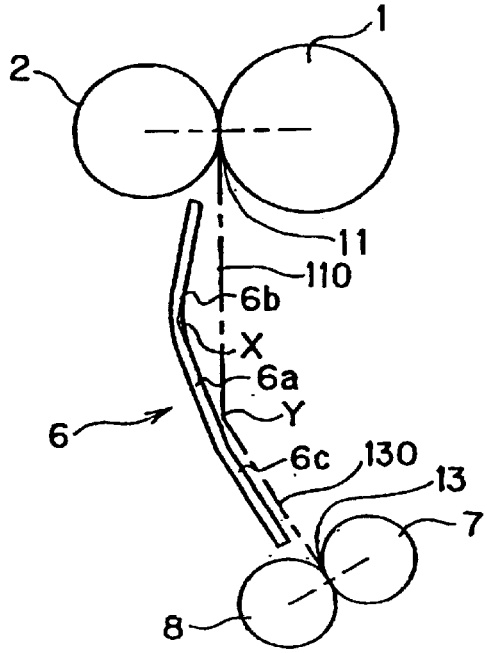
FIG. 18 is a diagram showing another example of the conveyance guide of the second embodiment of the present invention.
Figure 19:
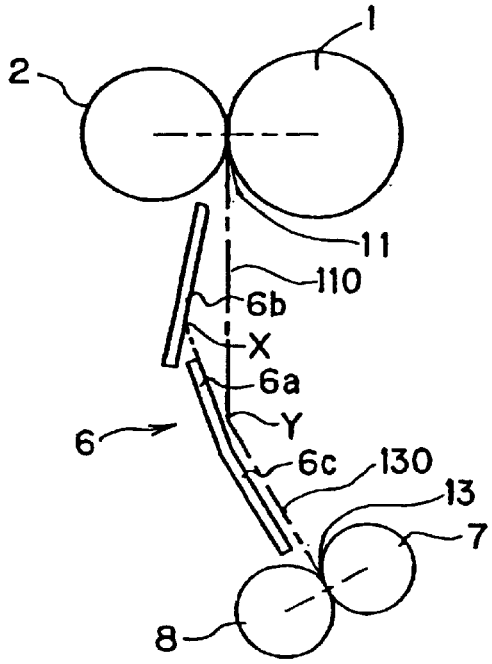
FIG. 19 is a diagram showing another example of the conveyance guide of the second embodiment of the present invention.

The construction of the conveyance guide 6 is not restricted to the one shown in FIG. 17, in which it consists of a continuous bent surface. It is also possible to adopt a construction in which, as shown in FIG. 18, the conveyance guide 6 is formed by surfaces (first and second guide surfaces 6*a* and 6*b*) connected by curved surface (connecting portion) or a construction in which, as shown in FIG. 19, the conveyance guide 6 is formed by divisional surfaces (first and second guide surfaces 6*a* and 6*b*). In these cases, it is also possible to define the bending point X in the same manner as in the case of the conveyance guide 6 of FIG. 17. That is, in the cases of FIGS. 18 and 19, the bending point X is defined as the intersection of imaginary extensions of the two surfaces (first and second guide surfaces) constituting the conveyance guide 6.

Thus, also in the case in which the surfaces constituting the conveyance guide 6 are connected by a curved surface (FIG. 18) and in the case in which the conveyance guide 6 is divided into a plurality of portions (FIG. 19), it is possible to form the conveyance guide 6 such that the bending point X is situated above the intersection Y of the nip plane 110 of the photosensitive drum 1 and the transfer roller 2 of the transfer portion and the registration roller pair nip plane 130.

Figure 20:
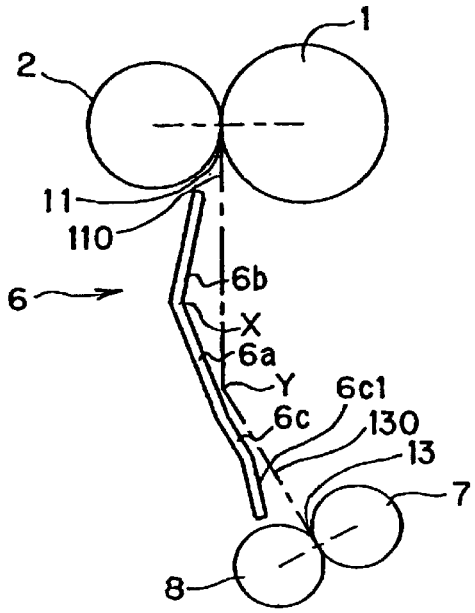
FIG. 20 is a diagram showing another example of the conveyance guide of the second embodiment of the present invention.

Further, as shown in FIG. 20, the conveyance guide 6 may have at the end portion of the third guide surface 6*c* an introducing portion 6*c*1 inclined such that the inclination angle on the side nearer to the registration roller pair nip portion 51 is raised more than the angle at which the sheet is discharged from the nip portion 13 of the registration roller pair 51. Due to this introducing portion 6*c*1, it is possible to scoop the sheet, which further helps to prevent jamming. It is also possible to provide the configuration of the end portion 6*c*1 in the conveyance guide 6 shown in FIGS. 18, 19, and 21.

Figure 21:
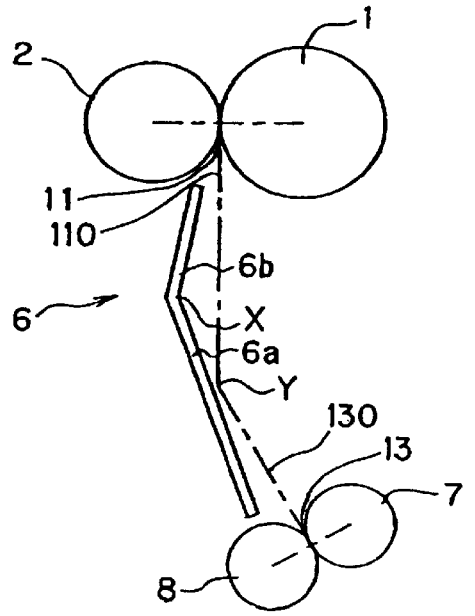
FIG. 21 is a diagram showing another example of the conveyance guide of the second embodiment of the present invention.
Figure 22:
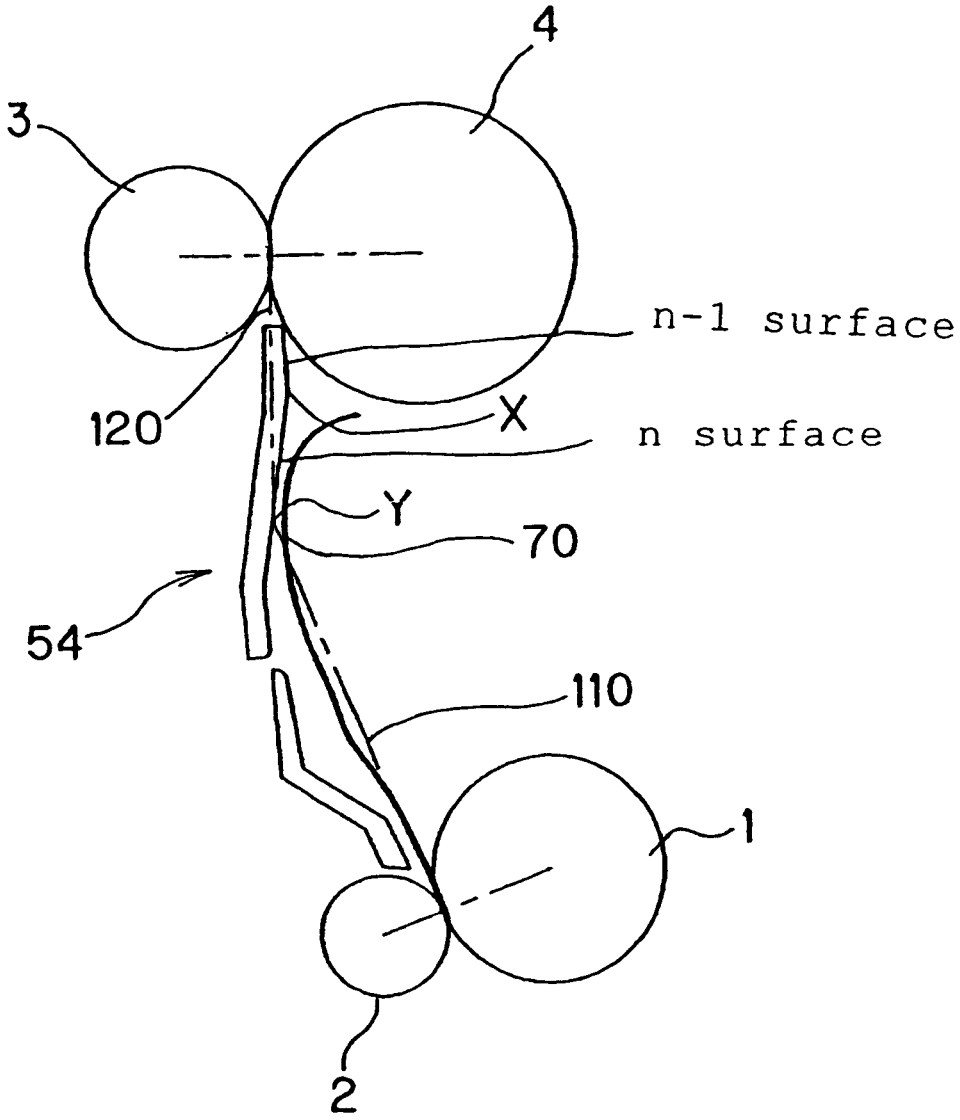
FIG. 22 PRIOR ART
FIG. 22 is a diagram showing an example of a conventional conveyance guide.

Further, as shown in FIG. 21, it is also possible to unite the first and third guide surfaces 6*a* and 6*c*, forming the conveyance guide 6 in two-surface structure.

Also in the conveyance guide 6 constructed as described above, it is possible to obtain the same function and effect as those of the conveyance guide 5 shown in FIG. 1.

What is claimed is:

1. A sheet conveying device, comprising:

upper and lower roller pairs; and a conveyance guide provided between the roller pairs and adapted to guide a sheet conveyed from said lower roller pair toward said upper roller pair, said two roller pairs arranged so that a nip plane of said upper roller pair intersects a nip plane of lower roller pair, wherein space is divided into inner and outer regions by a bent nip plane formed of both said nip planes intersecting each other, said conveyance guide situated in said outer region, wherein said conveyance guide has first and second guide surfaces for guiding the sheet which consists of two surfaces arranged vertically so as to intersect each other, wherein the intersection of the first and second guide surfaces is situated above the intersection of the nip plane of said lower roller pair and the nip plane of said upper roller pair, and wherein the intersection of the first and second guide surfaces is situated in said outer region divided by said bent nip plane.

2. A sheet conveying device according to claim 1, wherein a gap exists between the first guide surface and the second guide surface, and wherein an extension of the first guide surface and an extension of the second guide surface intersect.

3. A sheet conveying device according to claim 1, wherein said conveyance guide has between the first and second guide surfaces a connecting portion for connecting the first and second guide surfaces, wherein said connecting portion is curved in a sheet conveying direction, and wherein the intersection of the first and second guide surfaces is the intersection of an extension of the first guide surface and an extension of the second guide surface.

4. A sheet conveying device according to any one of claims 1 to 3, wherein said conveyance guide has on said lower roller pair side an introducing portion having a surface inclined so as to be raised with respect to the direction in which the sheet is discharged from said lower roller pair.

5. A sheet conveying device according to claim 1, wherein said conveyance guide is equipped with a third guide surface, the first guide surface being situated below the second guide surface, said third guide surface being situated below the first guide surface, the third guide surface being arranged substantially parallel to the nip plane of said lower roller pair, and the following relationship holding true:

$$10° \leqq A < B \leqq 30°$$

where A is the relative angle made by the third guide surface and the first guide surface, and B is the relative angle made by the first guide surface and the second guide surface.

6. A sheet conveying device according to claim 5, wherein the following relationship holds true:

$$Lc \leqq (La+Lb+Lc)/3$$

where La is the length of the first guide surface in the sheet conveying direction, Lb is the length of the second guide surface in the sheet conveying direction, and Lc is the length of the third guide surface in the sheet conveying direction.

7. A sheet conveying device according to any one of claims 1 to 3, wherein said conveyance guide has ribs protruding on a sheet supporting side and inclining to the both sides as they extend in the sheet conveying direction.

8. A sheet conveying device according to any one of claims 1 to 3, wherein said lower roller pair consists of an image bearing body bearing an unfixed image and a transfer roller for transferring the unfixed image borne by said image bearing body, and wherein said upper roller pair consists of a pair of fixing rollers for fixing the unfixed image borne by the sheet.

9. A sheet conveying device according to any one of claims 1 to 3, wherein said lower roller pair consists of a pair of registration rollers, and wherein said upper roller pair consists of an image bearing body for bearing an unfixed image and a transfer roller for transferring the unfixed image borne by said image bearing body.

10. An image forming apparatus comprising:

a sheet conveying device including upper and lower roller pairs, and a conveyance guide provided between the roller pairs and adapted to guide a sheet conveyed from said lower roller pair toward said upper roller pair, said two roller pairs arranged so that a nip plane of said upper roller pair intersects a nip plane of lower roller pair; and an image forming portion for forming an image on the sheet conveyed by said sheet conveying device, wherein space is divided into inner and outer regions by a bent nip plane formed of both said nip planes intersecting each other, said conveyance guide situated in said outer region, wherein said conveyance guide has first and second guide surfaces for guiding the sheet which consists of two surfaces arranged vertically so as to intersect each other, wherein the intersection of the first and second guide surfaces is situated above the intersection of the nip plane of said lower roller pair and the nip plane of said upper roller pair, and wherein the intersection of the first and second guide surfaces is situated in said outer region divided by said bent nip plane.

* * * * *

UNITED STATES PATENT AND TRADEMARK OFFICE

CERTIFICATE OF CORRECTION

PATENT NO. : 6,789,794 B2
DATED : September 14, 2004
INVENTOR(S) : Hideaki Miyazawa It is certified that error appears in the above-identified patent and that said Letters Patent is hereby corrected as shown below:

Drawings,
Sheet 11, Figure 14 A, "SYSTE" should read -- SYSTEM --; and "RIBSTO" should read -- RIBS TO --.

Column 2,
Line 52, "guide;" should read -- guides; --.

Column 6,
Line 31, "rib" should read -- ribs --.
Line 36, "rib" should read -- of ribs --.

Column 7,
Line 31, "±14 mm," should read -- ±1.4 mm, --.
Line 35, "14.6 mm" should read -- ±4.6 mm --.
Line 36, "12.8 mm," should read -- ±2.8 mm, --.

Signed and Sealed this

Fifteenth Day of March, 2005

JON W. DUDAS
*Director of the United States Patent and Trademark Office*